US011414232B2

(12) United States Patent
Vicktorius et al.

(10) Patent No.: US 11,414,232 B2
(45) Date of Patent: Aug. 16, 2022

(54) DEVICE AND METHOD FOR LABELING INDIVIDUAL PRODUCTS

(71) Applicant: ESPERA-WERKE GmbH, Duisburg (DE)

(72) Inventors: Winfried Vicktorius, Duisburg (DE); Peter Wolff, Swisttal-Heimerzheim (DE); Ralf Thomas Treder, Herne (DE); Andreas Matheus Adrianus Van Roozendaal, Herne (DE)

(73) Assignee: Espera-Werke GmbH, Duisburg (DE)

( * ) Notice: Subject to any disclaimer, the term of this patent is extended or adjusted under 35 U.S.C. 154(b) by 590 days.

(21) Appl. No.: 15/762,133

(22) PCT Filed: Sep. 23, 2016

(86) PCT No.: PCT/EP2016/072672

§ 371 (c)(1),
(2) Date: Mar. 22, 2018

(87) PCT Pub. No.: WO2017/050959

PCT Pub. Date: Mar. 30, 2017

(65) Prior Publication Data

US 2018/0273229 A1 Sep. 27, 2018

(30) Foreign Application Priority Data

Sep. 24, 2015 (DE) ..... 10 2015 116 166.4

(51) Int. Cl.
*B65C 9/18* (2006.01)
*B65C 9/00* (2006.01)
(Continued)

(52) U.S. Cl.
CPC ..... *B65C 9/18* (2013.01); *B65C 9/0006* (2013.01); *B65C 9/02* (2013.01); *B65C 9/30* (2013.01)

(58) Field of Classification Search
CPC ..... B65C 9/18; B65C 9/2204
See application file for complete search history.

(56) References Cited

U.S. PATENT DOCUMENTS 3,112,236 A * 11/1963 Hartman ..... B65C 9/08 156/364
5,300,160 A * 4/1994 Wilson ..... B65C 9/1884 156/542

(Continued)

FOREIGN PATENT DOCUMENTS

DE 102009014992 A1 * 9/2010 ..... B41J 11/0005
GB 1387101 A * 3/1975 ..... B65C 3/16

(Continued)

OTHER PUBLICATIONS

Machine translation JP2002321721A (Year: 2002).*
Machine translation DE102009014992A (Year: 2010).*

*Primary Examiner* — Francisco W Tschen
*Assistant Examiner* — Wayne K. Swier
(74) *Attorney, Agent, or Firm* — Rankin, Hill & Clark LLP

(57) ABSTRACT

The invention relates to a device (1) for labeling individual products (2), comprising an advancing device (3) for transporting each product (2) in a transport direction (X), a label dispensing device (4) for dispensing a label, which can be removed from a material strip (5), from a discharge point (6) in a dispensing direction (S), and a label transporting device (7) with a movable label transporting means (8) for transporting the dispensed label (5) from a transfer region (9), where the dispensed label (5) is transferred to the label transporting mean (8), to a delivery point (10), where the label (5) is applied onto the respective product (2). The label transport means (8) has a surface (11) which is brought into contact with the label (5). The aim of the invention is to simplify the labeling of individual products (2) and apply the (Continued)

Figure 1:
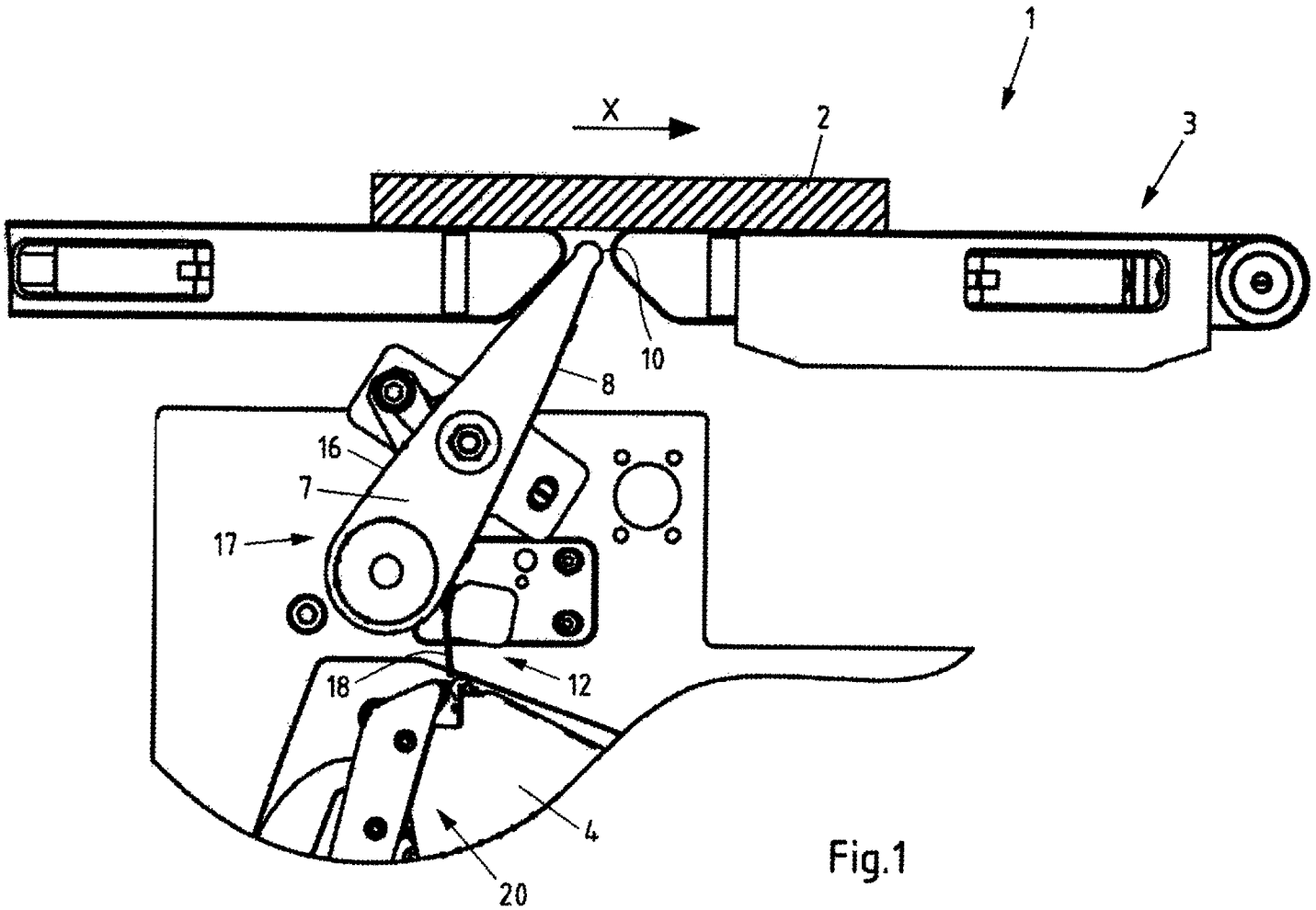

labels (5) as precisely as possible. According to the invention, this is achieved in that the device (1) additionally has a label aligning device (12) with a roller (13) which has a roller axis (14) that is parallel to the surface (11) of the label transporting means (8) and a lateral surface (15) that is arranged circumferentially about the roller axis (14). The roller (13) is arranged such that an imaginary straight line (G) running from the discharge point (6) in the dispensing direction (S) intersects the lateral surface (15). The invention further relates to a corresponding method for labeling individual products (2).

20 Claims, 4 Drawing Sheets

(51) Int. Cl.
*B65C 9/02* (2006.01)
*B65C 9/30* (2006.01)

(56) References Cited

U.S. PATENT DOCUMENTS

| | | | | |
|---|---|---|---|---|
| 5,718,525 | A * | 2/1998 | Bruhnke | B41J 3/4075 400/586 |
| 7,293,592 | B1 | 11/2007 | Golicz et al. | |
| 2007/0039684 | A1 | 2/2007 | Nedblake | |
| 2011/0067809 | A1 * | 3/2011 | Broad | B65C 9/1803 156/580 |
| 2016/0167821 | A1 * | 6/2016 | Krämer | B65C 9/1815 156/256 |

FOREIGN PATENT DOCUMENTS

| | | | | |
|---|---|---|---|---|
| JP | 2002321721 | A * | 11/2002 | B41J 11/0005 |
| JP | 2004352309 | A | 12/2004 | |
| JP | 2009234595 | A | 10/2009 | |
| WO | 2015010868 | A1 | 1/2015 | |

* cited by examiner

DEVICE AND METHOD FOR LABELING INDIVIDUAL PRODUCTS

The present invention relates to an apparatus for labeling individual products, having an advancing device for transporting each particular product in a transporting direction, having a label dispensing device for dispensing a label, which is detachable from a material strip, in a dispensing direction from an output location, and having a label transfer device with a movable label transport means for transferring the dispensed label from an acquisition region, in which the dispensed label is acquired by the label transport means, to a delivery location, at which the label is applied to the particular product, wherein the label transport means has a surface which is brought into contact with the label.

The invention also relates to a method for labeling individual products, in which a label is dispensed in a dispensing direction from an output location of a label dispensing device, in which the dispensed label is passed from the label dispensing device to a label transfer device, in which the label is transported from an acquisition region of the label transfer device to a delivery location of the label transfer device, and in which the label is transferred from the delivery location to the product to be labeled.

A corresponding apparatus and a corresponding method are known for example from JP 2004 352309 A. In the known apparatus for labeling individual products, a material strip having labels is unwound as a rolled web, wherein the labels are separated from the rest of the material strip by a cutting device and thus singularized. The labels are thus in this case each a section of a printable or printed material strip which has been detached from the rest of the material strip by severing.

After being severed, the individual labels are transported by means of a label transfer device, which has a transport belt or endless belt as label transport means, from the acquisition region, in which each particular label is acquired by the label transport means, to the delivery location, at which each particular label is applied to the product to be labeled.

In order to be able to sever a label or said section from the rest of the material strip, the material strip has to be pressed against the transport belt of the label transfer device with its front end, which forms the subsequent label, and the transport belt has to be stopped. The material strip is pressed against the transport belt via a clamping roller, with which the front end of the material strip is clamped between the transport belt and clamping roller. The material strip, which is then taut, is then cut at a defined location, producing a label. The severed label is still clamped with its front end between the clamping roller and the transport belt. Only then is the transport belt set into motion and the label is conveyed to the delivery location.

The labels are adhesive labels, wherein the adhesive side faces away from the label transfer device while being transported thereby. In order that the label sticks to the transport belt of the label transfer device, a suction flow is generated by means of a blower (in this case in the form of a fan), which draws the label onto the surface of the transport belt.

The apparatus, known from the prior art, for labeling individual products has a relatively complex construction. Thus, a blower is required in order to generate a suction flow which keeps the label on the label transport belt while it is being transported. Furthermore, in order to sever the individual labels from the rest of the material strip, a clamping roller is required, which permanently presses against the surface of the transport belt of the label transfer device; therefore, not only is an additional part in the form of the clamping roller required for severing, but also, as a result of the continuous pressure of this clamping roller on the transport belt, the transport belt is exposed to a high level of wear in the long term.

Therefore, it is an object of the present invention to specify an apparatus and a corresponding method with which the labeling of individual products is simplified and the labels are applied as precisely as possible.

The object established and indicated above is achieved, according to a first teaching of the present invention, in the case of an apparatus for labeling individual products,

- having an advancing device for transporting each particular product in a transporting direction, in particular a horizontal transporting direction,
- having a label dispensing device for dispensing a label, which is detachable from a material strip and in particular is attached in a detachable manner to a backing strip, in a dispensing direction from an output location (of the label dispensing device), and
- having a label transfer device with a movable label transport means, in particular an endless belt (transport belt), for transferring the dispensed label from an acquisition region (of the label transfer device), in which the dispensed label is (able to be) acquired by the label transport means, to a delivery location (of the label transfer device), at which the label is (able to be) applied to the particular product, wherein the label transport means has a surface which is (able to be) brought into contact with the label, in that the apparatus also has a label orienting device with a roller which has a roller axis parallel to the surface of the label transport means and a lateral surface arranged circumferentially around the roller axis, wherein the roller is arranged such that an imaginary straight line proceeding from the output location and extending in the dispensing direction intersects the lateral surface.

The presence of a label orienting device as defined above makes it possible, as will be explained in the following text, to convey adhesive labels in a particularly precise arrangement from the acquisition region to the delivery location with their adhesive side facing the surface of the label transport means.

Since the adhesive surface comes into contact with the surface of the label transport means, the label sticks automatically and there is no need for an additional blower as in the prior art in order to draw the label onto the label transport means by means of suction. Since the labels can be supplied as a rolled web, they are now inevitably curved differently (labels in the outer region of the rolled web are curved less than labels in the inner region of the rolled web). Since the adhesive side frequently faces inward in the rolled web, the different degrees of curvature have the drawback that the front end of the dispensed label does not always come into contact with the surface of the label transport means at the same location. The greater the difference in degree of curvature of the labels, the greater the distance between the locations at which each particular label comes into contact with the surface of the label transport means. When the adhesive side of the dispensed labels is directed toward the surface of the label transport means, the front end of each particular label immediately sticks to the label transport means as soon as it comes into contact therewith, and is then conveyed onward to the product in a manner positioned in such a way. The presence of the special label orienting device ensures that the labels do not come into contact with the surface of the label transport means in a random position, which depends, inter alia, on the particular degree of curvature of the label, but in a defined acquisition region. Compared with the region in which, according to the prior art, the labels would come into contact with the surface of the label transport means, this acquisition region is much smaller. The acquisition region measures for example only 1 to 6 mm, preferably 1 to 4 mm, particularly preferably 1 to 3 mm, with respect to the direction from the acquisition region to the delivery location of the label transfer device. As a result of this very small defined region in which the front ends of the labels come into contact with the surface of the label transport means, precise and not random positioning of the label on the product is subsequently also ensured.

As a result of the apparatus according to the invention and especially as a result of the presence of the label orienting device defined above, labeling of individual products with simple means, specifically with a high degree of precision, is enabled.

The label orienting device provided according to the invention ensures that each label first of all comes into contact with the lateral surface of the roller, regardless of its degree of curvature and possibly even regardless of the direction in which the label is curved, wherein the roller then always deflects the front end of each particular label into the defined acquisition region (which is very narrow according to the invention). This manner of orienting and deflecting the individual labels can additionally (optionally) be supported in that a sliding plate is provided in the gap between the output location of the label dispensing device and the roller of the label orienting device. Each particular label then comes, starting from the label dispensing device or the output location, first of all into contact with the sliding plate, which will be described in more detail below, and the sliding plate guides the front end of the label precisely to the roller and in particular to a defined region of the lateral surface of the roller. Additionally or alternatively, it is also (optionally) possible for a nozzle, in particular a blowing and/or suction nozzle, which will likewise be explained in more detail below, to be provided, which likewise guides the front end of the label to the roller and in particular to a defined region of the lateral surface of the roller. The roller and optionally the sliding plate and/or the nozzle are thus positioned such that the label dispensed in each case always comes into contact with the roller first of all, before it comes into contact with the label transport means. According to the invention, provision is made in particular here for the label orienting device to be configured, or for the roller and optionally the sliding plate and/or the nozzle to be arranged, such that the acquisition region, in which the front end of the label comes into contact with the surface of the label transport means, is minimized, as specified above for example to a length of 1 to 6 mm, preferably 1 to 4 mm, particularly preferably 1 to 3 mm. In this way, the accuracy with which the front end of the label comes into contact with the surface of the label transport means is increased even further.

The roller of the label orienting device also has the additional advantage that, before it comes into contact with the surface of the label transport means, a label is oriented exactly by first of all coming into contact with the lateral surface of the roller with its front end. This ensures that the front end of the label then comes into contact with the surface of the label transport means as far as possible at the same time across its entire width. If the label were to skew a little during dispensing, it would otherwise not come into contact with the label transport means with its entire front edge, but only with a portion thereof or with a corner of the front region of the label, and would then be entrained at an angle. This would in turn result in inclined and thus imprecise application to the product.

Various configurations according to the invention will now be described in the following text.

First of all, it should be noted that a label that is detachable from a material strip preferably means a label which is applied in a detachable manner to a backing strip, which in this case forms the material strip and can consist of paper or plastic. For this case, the label dispensing device has a dispensing edge (deflecting edge), at which the backing strip is deflected strongly, for example through 90° or more, with the result that the label is automatically detached from the backing strip. The dispensing edge forms or defines the output location of the label dispensing device, i.e. the location at which the label is output or delivered in the dispensing direction. In principle, a label that is detachable from a material strip is also understood to be the case in which the label is created by severing a section from a printable material strip, as in the prior art described at the beginning.

According to one configuration of the apparatus according to the invention, the label transport device has, as label transport means, which transports the label from the acquisition region to the delivery location on account of its movement, in particular circulating movement, an endless belt, as mentioned above. The endless belt runs through the acquisition region and the delivery location, such that each particular label can be transported to the delivery location after it has been acquired by the label transport means (first of all with its front edge and then fully) in the acquisition region. The label transfer device is in particular a label accelerating belt, i.e., after the label has been acquired by the label transport means or transport belt in the acquisition region, said label transport means or transport belt is accelerated and then, once the label has been transferred onto the product, decelerated again.

This is because the advancing device on which the products to be labeled are transported generally runs at a greater advancing speed than the speed at which the label is dispensed and/or printed. By way of such a label accelerating belt, the label can then be accelerated while it is being transported from the dispensing device to the product and then has the same speed as the product itself directly at the product. Therefore, the advancing device does not have to be stopped or decelerated, or even be conveyed at a lower speed from the outset, in order for the label to be transferred onto the product.

According to a further configuration of the apparatus according to the invention, the perpendicular projection of the lateral surface of the roller onto the surface of the label transport means, in particular onto the surface of the endless belt, intersects or encircles the acquisition region, in which the dispensed label is acquired by the label transport means or endless belt. The label is thus first of all brought into contact with the roller with its front edge or its front end, and said roller then deflects the front end of the label into said acquisition region immediately next to the roller.

According to yet another configuration of the apparatus according to the invention, the roller is in contact with the surface of the label transport means, this having the advantage that the roller automatically always has a circumferential speed that is synchronous with (the same as) the speed of the label transport means. In this case, the roller does not have to be driven itself. Alternatively, however, it is also conceivable for the roller to be spaced apart from the surface of the label transport means by 0.5 to 3 mm, preferably 0.5 to 2 mm, particularly preferably 0.5 to 1 mm. Therefore, in order to ensure the function according to the invention and in particular for the label to be transported by means of the label transfer device, it is not necessary for the roller to touch the surface of the label transport means. In contrast to the prior art, in the latter case the roller according to the invention is not a clamping roller and thus does not exert a continuous pressure on the label transport means or transport belt, which would increase the wearing of the label transport means in the long term.

According to yet another configuration of the apparatus according to the invention, the shortest distance between the lateral surface (of the roller) and/or the surface (of the label transport means) and the output location (of the label dispensing device) is 10 to 50 mm, preferably 20 to 40 mm, particularly preferably 25 to 35 mm. Such a relatively large distance or gap has the advantage that in the event that the label dispensing device has a printing unit, the printing speed and the speed of the label transport means or transport belt can be synchronized. Thus, in the period in which the label is printed at the speed of the printing unit (printing speed) and crosses the gap, the speed of the label transport means or transport belt can first of all be accelerated in order to transport and apply the preceding label and then decelerated again to the printing speed.

According to a further configuration of the apparatus according to the invention, the roller is driven. In principle, it can also roll freely, however.

According to another configuration of the apparatus according to the invention, provision is made for the imaginary straight line (which proceeds from the output location and extends in the dispensing direction) to extend in a region which is located between a first plane, in which the output location and the roller axis extend, and a second plane, in which the output location extends and which tangentially touches the lateral surface on that side of the roller that faces the label transport means. Such an orientation or arrangement is advantageous particularly when the roller rolls freely such that the label is always deflected by the roller in the direction of the surface of the label transport means or transport belt.

According to yet another configuration of the apparatus according to the invention, the label orienting device has, as mentioned above, a sliding plate which is arranged between the output location and the roller and extends parallel or at an acute angle to the dispensing direction. The sliding plate is in particular arranged such that the imaginary straight line (which proceeds from the output location and extends in the dispensing direction) extends parallel to the surface of the sliding plate or intersects the surface of the sliding plate. This always ensures that the label which is dispensed at the output location first of all meets the sliding plate and the front end of the label is guided to the roller in a defined manner there. Provision is preferably made here for the projection of the sliding plate in a direction parallel to the dispensing direction to intersect the lateral surface, in particular in the region between the first plane and the second plane. Preferably, the sliding plate is provided with a non-stick coating at least on the side which comes into contact with the label. Thus, the front edge of the label, on which it is also possible for adhesive to be located in the case of an adhesive label, cannot stick to the sliding plate.

According to another configuration of the apparatus according to the invention, the label orienting device has, as mentioned above, a nozzle (blowing or air nozzle), the main emission direction of which is directed toward the roller and/or toward the sliding plate. In principle, it is also possible for one or more suction nozzles to be provided, which guide each particular label in the direction of the roller and/or draw it onto the sliding plate. With such a nozzle, the front end of the dispensed label can likewise be guided easily, thereby ensuring that the label first of all comes into contact with the roller and only then with the surface of the label transport means or endless belt.

According to another configuration of the apparatus according to the invention, the label dispensing device has, as mentioned above, a printing unit for printing on the label that is detachable from the material strip. In principle, however, it is also conceivable for labels that have previously been printed to be arranged in the label dispensing device, for example in the form of a rolled web, and to be dispensed by the label dispensing device. In this case, a printing unit is not absolutely necessary as a constituent part of the label dispensing device. In this case, it is conceivable for the apparatus according to the invention to be configured such that the printing speed of the labels (advancing speed of the labels while they are each being printed) or the transport speed of the labels (advancing speed of the labels when they are not printed) to be at least 10 mm/s, preferably at least 50 mm/s, particularly preferably at least 100 mm/s at the output location of the label dispensing device. In particular, the printing or transport speed of the labels is in a range from 10 to 1500 mm/s, preferably in a range from 50 to 400 mm/s, particularly preferably in a range from 100 to 200 mm/s.

The object is also achieved, according to a second teaching of the present invention, in the case of a method for labeling individual products, in particular using an apparatus as defined above,

- in which a label is dispensed in a dispensing direction from an output location of a label dispensing device,
- in which the dispensed label is passed from the label dispensing device to a label transfer device,
- in which the label is transported from an acquisition region of the label transfer device to a delivery location of the label transfer device, and
- in which the label is transferred from the delivery location to the product to be labeled, in that, during the step of passing the label from the label dispensing device to the label transfer device, the label is first of all brought into contact with a roller of a label orienting device and only then is the label brought into contact with the label transfer device.

As has already been explained in connection with the apparatus according to the invention, the method according to the invention ensures that, in the event that the labels are intended to be applied to the label transport means or endless belt with the adhesive side, the labels always come into contact with the label transport means in a defined acquisition region. Regardless of the degree of curvature of the labels and optionally also of the direction of the curvature, it is thus possible to ensure the labeling of individual products with a high level of precision with simple means. This also ensures that the label always meets the label transport means fully with its entire front edge, and thus is not attracted and transported at an angle.

It should be noted that the present invention particularly preferably serves for the use of adhesive labels as labels, wherein the adhesive side of the adhesive label is then particularly preferably intended to be brought into contact with the surface of the label transport means. In principle, however, both the apparatus according to the invention and the method according to the invention are also usable for adhesive-free labels, which, for example, are only provided with an adhesive surface later or are applied to an adhesive surface on the product. It is also conceivable in principle for the label, when it is an adhesive label, not to be brought into contact with the label transport means with its adhesive side but with the side facing away therefrom. However, in the event that the label does not have an adhesive surface which is brought into contact with the label transport means, it is then necessary for the label to be sucked or pressed onto the surface of the label transport means by means of a blower, in particular a fan or a nozzle, while the label is being transported from the acquisition region to the delivery location. Otherwise, it is possible according to the invention to dispense with such a blower, i.e. in this case the apparatus according to the invention does not have a fan or a nozzle which sucks or presses the label onto the surface of the label transport means.

According to a further configuration of the method according to the invention, the label thus, as stated, comes into contact with the label transfer device with its adhesive side. In particular, the label comes into contact with the roller only with its side facing away from the adhesive side.

In a corresponding manner, according to another configuration of the method, provision is also made, during the step of passing the label from the label dispensing device to the label transfer device, for the label first of all to come into contact with a sliding plate before coming into contact with the roller. Finally, additionally or alternatively, according to another configuration of the method according to the invention, provision is made, during the step of passing the label from the label dispensing device to the label transfer device, for the label to be captured by an air jet produced by a nozzle and in particular to be pressed against the roller and/or the sliding plate thereby.

Figure 2A:
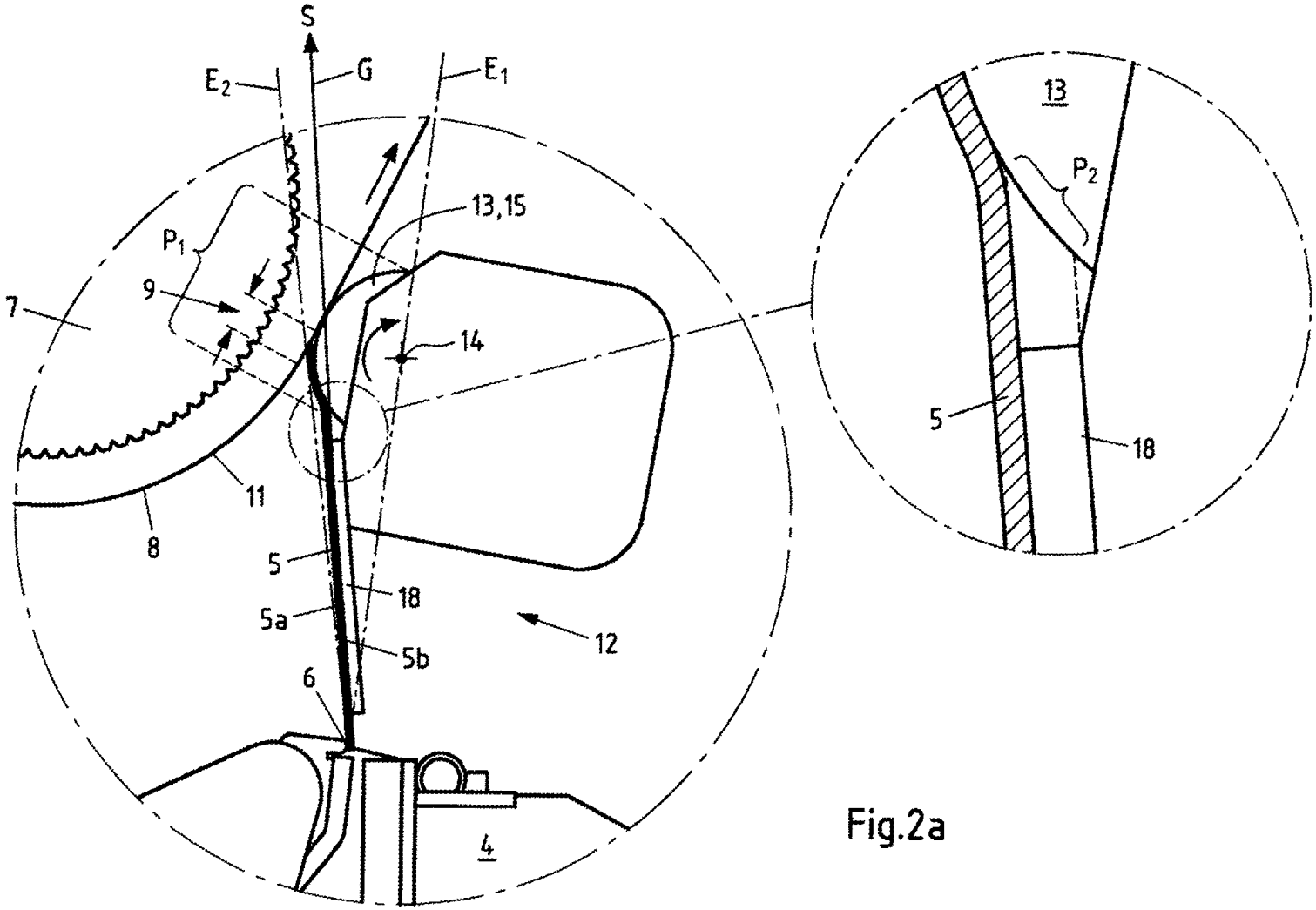

There are thus a large number of possible ways of configuring and developing the apparatus according to the invention and the method according to the invention. In this regard, reference should be made to the claims dependent on independent claims 1 and 12 and also to the description of exemplary embodiments in conjunction with the drawing, in which:

FIG. 1 shows a side view of a detail of an apparatus according to the present invention, and FIG. 2*a*)-*c*) show a schematic illustration of the carrying out of the method according to the invention with differently curved labels.

FIG. 1 shows an apparatus 1 for labeling individual products 2, having an advancing device 3 for transporting each particular product 2 in a transporting direction X.

The apparatus 1 has a label dispensing device 4 for dispensing a label 5, which is detachable from a material strip, in a dispensing direction S from an output location 6. The output location 6 is in this case a dispensing edge at which a material strip (not illustrated) is deflected strongly enough for labels 5 sticking thereto to be detached and moved onward in the dispensing direction S. The label dispensing device 4 additionally has a printing unit 20 with which the individual labels 5 are printed on.

The apparatus 1 also has a label transfer device 7, which is provide with a belt-type, movable label transport means 8 for transferring the dispensed label 5 from an acquisition region 9, at which the dispensed label 5 is acquired by the label transport means 8, to a delivery location 10, at which the label 5 is applied to the particular product 2. The label transport means 8 configured as an endless belt 16 has a surface 11 which comes into contact with the label 5, specifically with the adhesive side 5*a* of the label 5.

An essential feature of the apparatus 1 is the presence of a label orienting device 12 with a roller 13 which has a roller axis 14 parallel to the surface 11 of the endless belt 16 and a lateral surface 15 arranged circumferentially around the roller axis 14. The roller 13 is in this case arranged such that an imaginary straight line G proceeding from the output location 6 and in the dispensing direction S intersects the lateral surface 15.

In the present case, the roller 13 is a corotating roller 13 that bears against the label transport means 8, which is thus not itself driven. A drive is also conceivable, however, in particular when the roller 13 is a freely rolling roller.

As is clear from FIG. 2*a*), the roller 13 is arranged relative to the dispensing direction S such that the imaginary straight line G extends in a region which is located between a first plane $E_1$, in which the output location 6 and the roller axis 14 extend, and a second plane $E_2$, in which the output location 6 extends and touches that side of the roller 13 that faces the label transport means 8. In this case, the roller is arranged such that the perpendicular projection $P_1$ of the lateral surface 15 of the roller 13 onto the surface 11 of the endless belt 16 encircles the acquisition region 9 in which the dispensed label 5 is acquired by the endless belt 16.

Figure 2B:
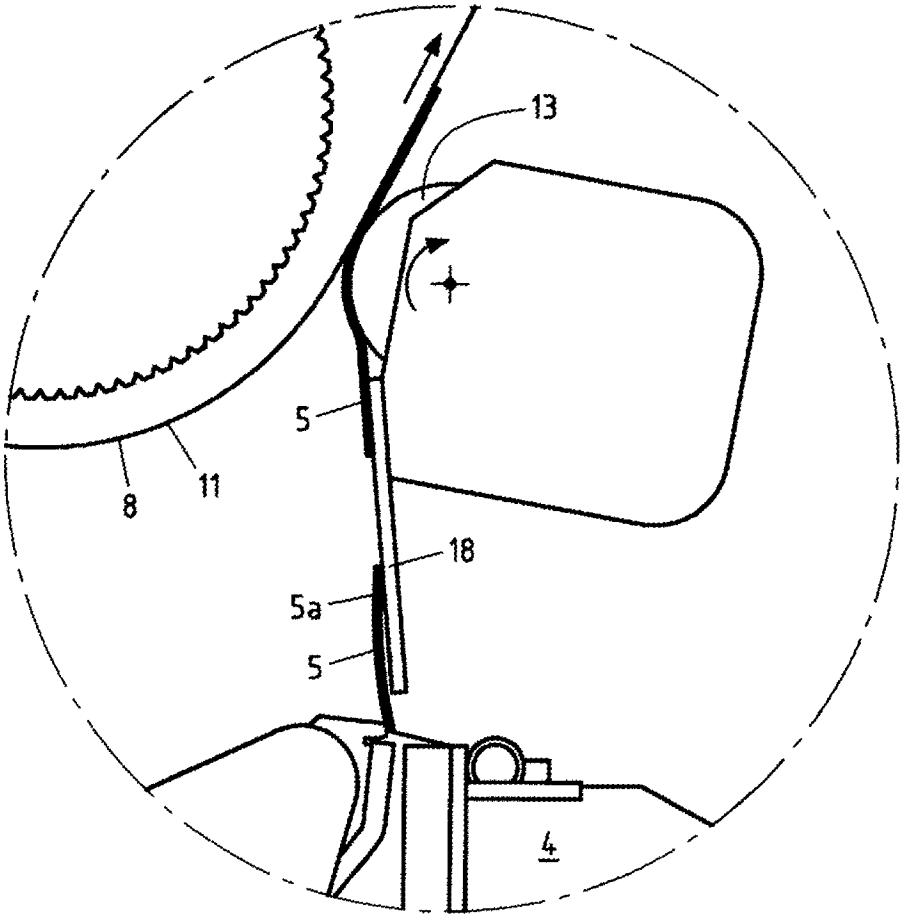
Figure 2C:
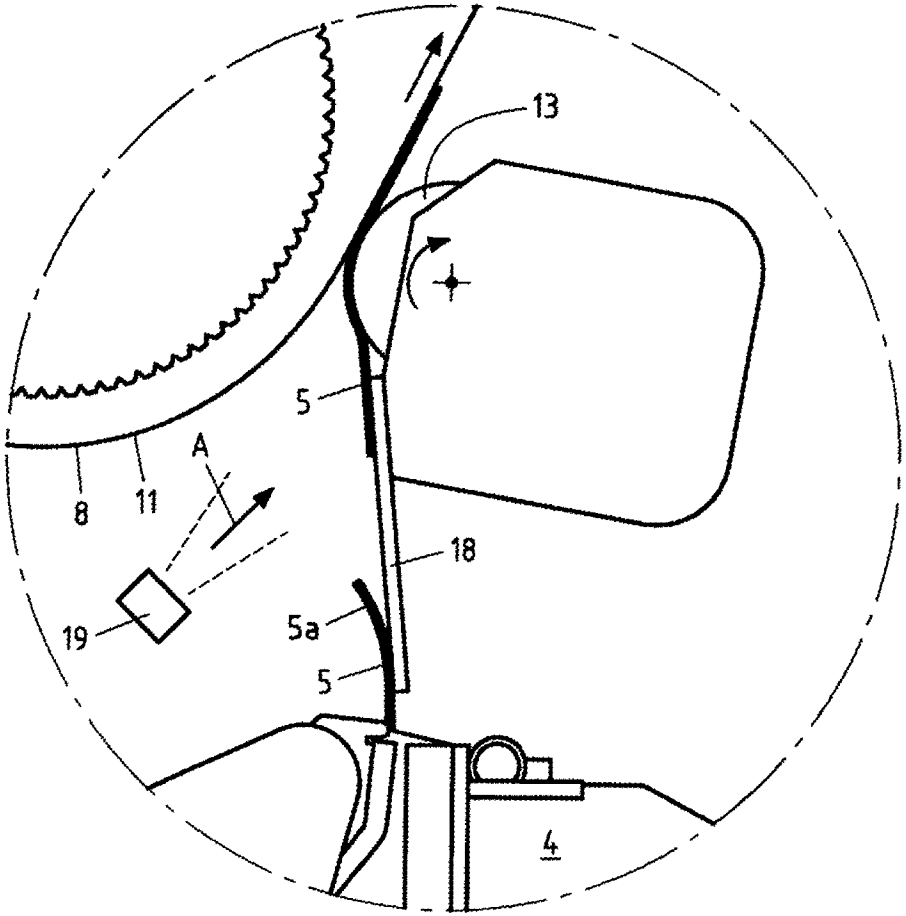

Furthermore, the label orienting device 12, illustrated here by way of example, has a sliding plate 18 and additionally, in the exemplary embodiment in FIG. 2*c*), also a nozzle 19.

The sliding plate 18 is arranged between the output location 6 and the roller 13 and extends in this case parallel to the dispensing direction S. The sliding plate 18 is in this case arranged such that the projection $P_2$ of the sliding plate 18 in a direction parallel to the dispensing direction S intersects the lateral surface 15 in the region between the first plane $E_1$ and the second plane $E_2$.

The main emission direction A of the nozzle illustrated in FIG. 2*c*) is in this case directed toward the roller 13 and toward the front end, facing the roller 13, of the sliding plate 18.

In FIGS. 2*a*) to *c*), different degrees of curvature and directions of curvature of labels 5 are illustrated. According to FIG. 2*a*), the label 5 does not have any appreciable curvature. In FIG. 2*b*), the label is curved slightly to the right and in FIG. 2*c*), it is curved slightly to the left. As is clearly discernible, as a result of the apparatus 1 according to the invention, the front end of each label 5 is always brought into contact with the surface 11 of the label transport means 8 in the same narrow region, namely in the acquisition region 9, which is only a few millimeters wide. This ensures that each label 5 is placed precisely on the label transport means 8 and thus also ultimately arranged on the product 2 to be labeled with great accuracy and reproducibility.

LIST OF REFERENCE SIGNS

1 Apparatus for labeling individual products
2 Product
3 Advancing device
4 Label dispensing device
5 Label
5*a* Adhesive side of the label
5*b* Side of the label facing away from the adhesive side
6 Output location of the label dispensing device
7 Label transfer device
8 Label transport means
9 Acquisition region of the label transfer device
10 Delivery location of the label transfer device
11 Surface of the label transport means
12 Label orienting device

13 Roller
14 Roller axis
15 Lateral surface of the roller
16 Endless belt
17 Label acceleration belt
18 Sliding plate
19 Nozzle
20 Printing unit
S Dispensing direction
G Straight line
$P_1$ Projection of the lateral surface onto the surface of the label transport means
$P_2$ Projection of the sliding plate onto the lateral surface
$E_1$ First plane
$E_2$ Second plane
A Main emission direction of the nozzle

The invention claimed is:

1. An apparatus for labeling individual products comprising:

an advancing device for transporting each individual product in a transporting direction;

a label dispensing device for dispensing a label, said label being detachable from a material strip, in a dispensing direction from an output location at which the label is detached from the material strip by a dispensing edge or is created by severing a section from the material strip and thus becomes a dispensed label;

a label transfer device with a movable label transport means for transferring the dispensed label from an acquisition region, in which the dispensed label is acquired by the label transport means, to a delivery location, at which the dispensed label is applied to the individual product, wherein the label transport means has a surface which is brought into contact with the dispensed label; and a label orienting device with a roller which has a roller axis parallel to the surface of the label transport means and a lateral surface arranged circumferentially around the roller axis, wherein the roller is arranged such that an imaginary straight line proceeding from the output location and extending in the dispensing direction intersects the lateral surface;

wherein the roller is configured to deflect the front end of the dispensed label into contact with the surface of the label transport means in the acquisition region, and wherein the label transport means is configured to acquire the dispensed label after the front end thereof is deflected into contact with the surface of the label transport means in the acquisition region and to transfer the dispensed label to the delivery location at which the dispensed label is applied to the individual product.

2. The apparatus as claimed in claim 1, wherein the label transfer device has, as the label transport means, an endless belt which runs through the acquisition region and the delivery location.

3. The apparatus as claimed in claim 1, wherein a perpendicular projection of the lateral surface of the roller onto the surface of the label transport means intersects or encircles the acquisition region, in which the dispensed label is acquired by the label transport means.

4. The apparatus as claimed in claim 1, wherein the roller is in contact with the surface of the label transport means or is spaced apart from the surface of the label transport means by 0.5 to 3 mm.

5. The apparatus as claimed in claim 1, wherein a shortest distance between the lateral surface and/or the surface and the output location is 10 to 50 mm.

6. The apparatus as claimed in claim 1, wherein the roller is driven or rolls freely.

7. The apparatus as claimed in claim 1, wherein the imaginary straight line extends in a region which is located between a first plane, in which the output location and the roller axis extend, and a second plane, in which the output location extends and which tangentially touches the lateral surface on a side of the roller that faces the label transport means.

8. The apparatus as claimed in claim 1, wherein the label orienting device has a sliding plate which is arranged between the output location and the roller and extends parallel or at an acute angle to the dispensing direction.

9. The apparatus as claimed in claim 8, wherein a projection of the sliding plate in a direction parallel to the dispensing direction intersects the lateral surface (15).

10. The apparatus as claimed in claim 8, wherein the label orienting device has a nozzle, and wherein the nozzle has a main emission direction that is directed toward the roller and/or toward the sliding plate.

11. The apparatus as claimed in claim 1, wherein the label dispensing device has a printing unit for printing on the label that is detachable from the material strip.

12. A method for labeling individual products comprising steps of:

dispensing a label in a dispensing direction from an output location of a label dispensing device, wherein at the output location the label is detached from a material strip by a dispensing edge or created by severing a section from the material strip and thus becomes a dispensed label;

passing the dispensed label from the label dispensing device to a label transfer device;

transporting the label from an acquisition region of the label transfer device to a delivery location of the label transfer device;

transferring the label from the delivery location to an individual product to be labeled; and during the step of passing the dispensed label from the label dispensing device to the label transfer device, bringing the dispensed label into contact with a roller of a label orienting device such that the front end of the dispensed label is deflected by the roller into contact with the acguisition region of label transfer device and the dispensed label is thereafter transported bv the label transfer device to the delivery location at which the dispensed label is applied to the individual product.

13. The method as claimed in claim 12, wherein the label is an adhesive label which has an adhesive side and a side facing away therefrom.

14. The method as claimed in claim 13, wherein the adhesive side of the dispensed label contacts the label transfer device.

15. The method as claimed in claim 12, wherein, during the step of passing the dispensed label from the label dispensing device to the label transfer device, bringing the dispensed label into contact with a sliding plate before bringing the dispensed label into contact with the roller.

16. The method as claimed in claim 12, wherein, during the step of passing the dispensed label from the label dispensing device to the label transfer device, the dispensed label is pressed against the roller by an airjet produced by a nozzle.

17. The method as claimed in claim 12, wherein the endless belt is a label accelerating belt.

18. The apparatus as claimed in claim 4, wherein the roller is spaced apart from the surface of the label transport means by 0.5 to 1 mm.

19. The apparatus as claimed in claim 5, wherein the shortest distance between the lateral surface and/or the surface and the output location is 25 to 35 mm.

20. The apparatus as claimed in claim 7, wherein the label orienting device has a sliding plate which is arranged between the output location and the roller and extends parallel or at an acute angle to the dispensing direction, and wherein a projection of the sliding plate in a direction parallel to the dispensing direction intersects the lateral surface in a region between the first plane and the second plane.

* * * * *